US006727444B1

(12) United States Patent
Lin

(10) Patent No.: US 6,727,444 B1
(45) Date of Patent: Apr. 27, 2004

(54) SWITCH FOR TOOL

(76) Inventor: Arlo H. T. Lin, Akara Building, 24 De Castro Street, Wickman Cay I, Road Town, Tortola (VG)

( * ) Notice: Subject to any disclaimer, the term of this patent is extended or adjusted under 35 U.S.C. 154(b) by 0 days.

(21) Appl. No.: 10/341,037

(22) Filed: Jan. 13, 2003

(51) Int. Cl.[7] ..... H01H 9/06
(52) U.S. Cl. ..... 200/61.86; 431/254
(58) Field of Search ..... 200/61.86, 16 R–16 F; 431/254, 255

(56) References Cited

U.S. PATENT DOCUMENTS 3,963,884 A * 6/1976 Pollock ..... 200/16 D
4,057,520 A * 11/1977 Schwartz ..... 200/16 D
4,180,712 A * 12/1979 Lutzenberger et al. .... 200/16 D
4,311,885 A * 1/1982 Arthur ..... 200/16 C
4,322,588 A * 3/1982 Chumley et al. ..... 200/16 C
5,412,179 A * 5/1995 Chen ..... 431/254
5,915,955 A * 6/1999 Lin ..... 431/344
6,171,099 B1 * 1/2001 Lin ..... 431/153
6,457,628 B1 * 10/2002 Lin ..... 228/20.1

* cited by examiner

*Primary Examiner*—James R. Scott
(74) *Attorney, Agent, or Firm*—Alan Kamrath

(57) ABSTRACT

An actuating mechanism for a tool includes a shell and a switch actuator. The shell includes a slot defined therein between two edges and at least one boss formed thereon. The switch actuator includes two hooks to be inserted through the slot for engagement with the two edges and at least one recess defined therein for receiving the at least one boss in a releasable manner. The switch actuator includes two tabs extending from a side thereof for insertion in the slot. The switch actuator includes a driving element extending from a side thereof through the slot for driving another element of the tool. The switch actuator includes a slot defined therein between two edges, at least one of which defines the at least one recess for receiving the at least one boss. The at least one boss is a semi-cylinder, and the at least one recess is semicircular. The shell includes two bosses, and each of the edges by the slot of the switch actuator defines a recess for receiving one of the bosses.

11 Claims, 8 Drawing Sheets

SWITCH FOR TOOL

BACKGROUND OF INVENTION

1. Field of Invention

The present invention relates to an actuating mechanism for a tool and, more particularly, to an actuating mechanism for a burner.

2. Related Prior Art

Taiwanese Patent Application No. 247615 discloses a conventional electronic burner. This conventional electronic burner includes a shell 1, a voltage generator 2 received in the shell 1, a lever 4 pivotally mounted on the shell 1 and a security element 6 movably mounted on the shell 1. The voltage generator 2 includes a button 20. The lever 4 is pivotally mounted on the shell 11 by means of a pin. The lever 4 includes a first end 41 in contact with the button 20. The security element 6 includes a sled 60 movably mounted on the shell 1. The sled 60 includes an end for contact with a second end of the lever 4. The security element 6 can be moved between a locking position and a releasing position. In the locking position, the end of the sled 60 contacts the second end of the lever 4 so that the lever 4 cannot be pivoted, i.e., the first end 41 of the lever 4 cannot push the button 20. Thus, a voltage cannot be produced via the voltage generator 2. In the releasing position, the end of the security element 6 is removed from the second end of the lever 4 so that the lever 4 can be pivoted. Thus, the fast end 41 of the lever 4 can push the button 20. Thus, a voltage can be produced via the voltage generator 2. However, operation of the security element 6 and operation of the lever 4 cannot be connected smoothly.

The present invention is therefore intended to obviate or at least alleviate the problems encountered in the prior art.

SUMMARY OF INVENTION

It is an objective of the present invention to provide a burner with a security device that is effective and easily operable.

According to the present invention, an actuating mechanism for a tool includes a shell and a switch actuator. The shell includes a slot defined therein between two edges and at least one boss formed thereon. The switch actuator includes two hooks inserted through the slot for engagement with the edges and at least one recess defined therein for receiving the at least one boss in a releasable manner The switch actuator includes two tabs extending from a side thereof for insertion in the slot. The switch actuator includes a driving element extending from a side thereof through the slot for driving another element of the tool. The switch actuator includes a slot defined therein between two edges, at least one of which defines a recess for receiving the at least one boss. The at least one boss is a semi-cylinder, and the at least one recess is semi-circular. The shell includes two bosses, and each of the edges by the slot of the switch actuator defines a recess for receiving one of the bosses.

Other objectves, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
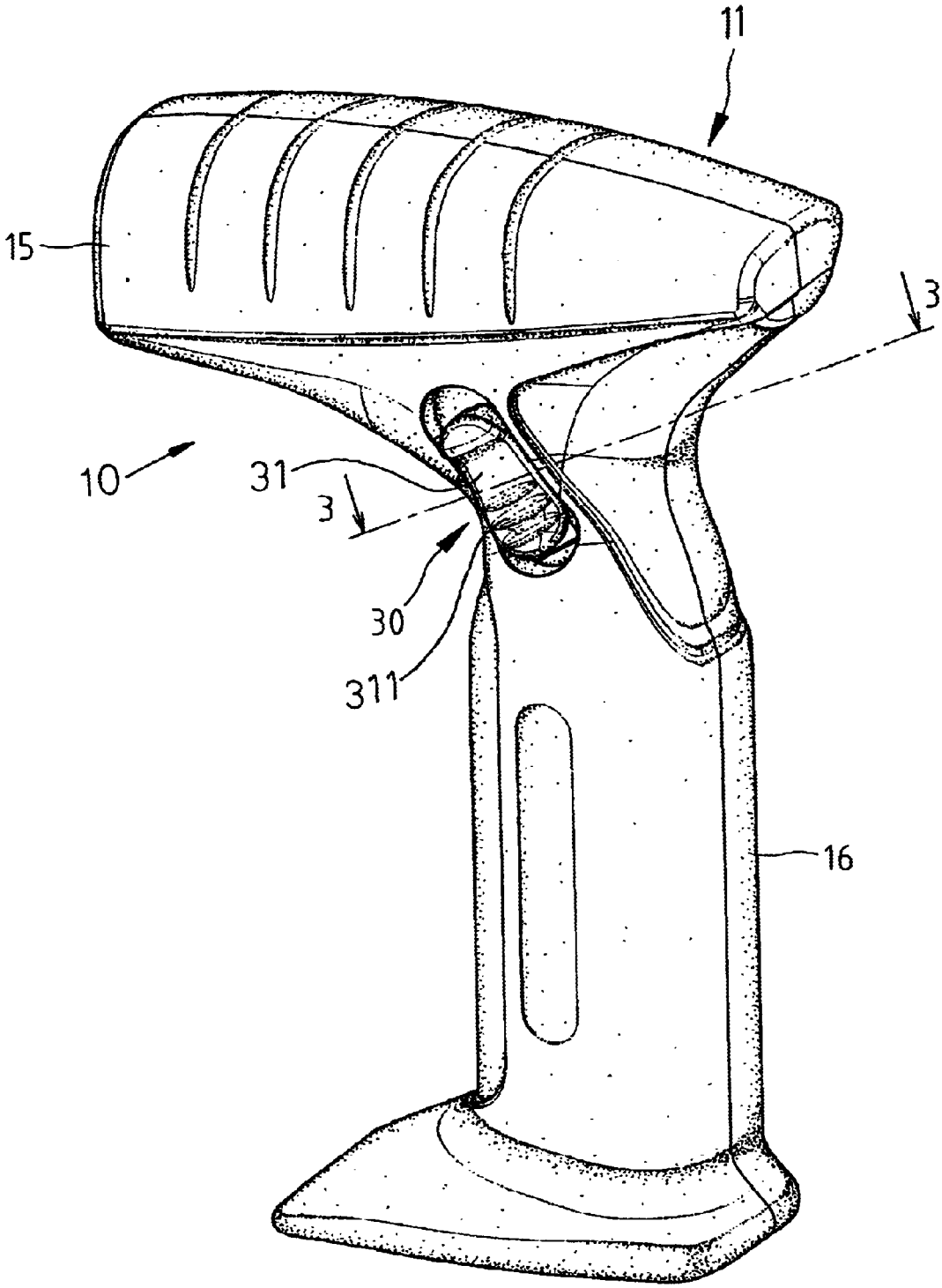
FIG. 1 is a perspective view of a tool equipped with an actuating mechanism according to the preferred embodiment of the present invention.

Referring to FIG. 1, a burner 10 is equipped with an actuating mechanism including a shell 11 and a switch actuator 30. The shell 11 includes a barrel 15 and a handle 16 and is made of two halves (not numbered).

Figure 6:
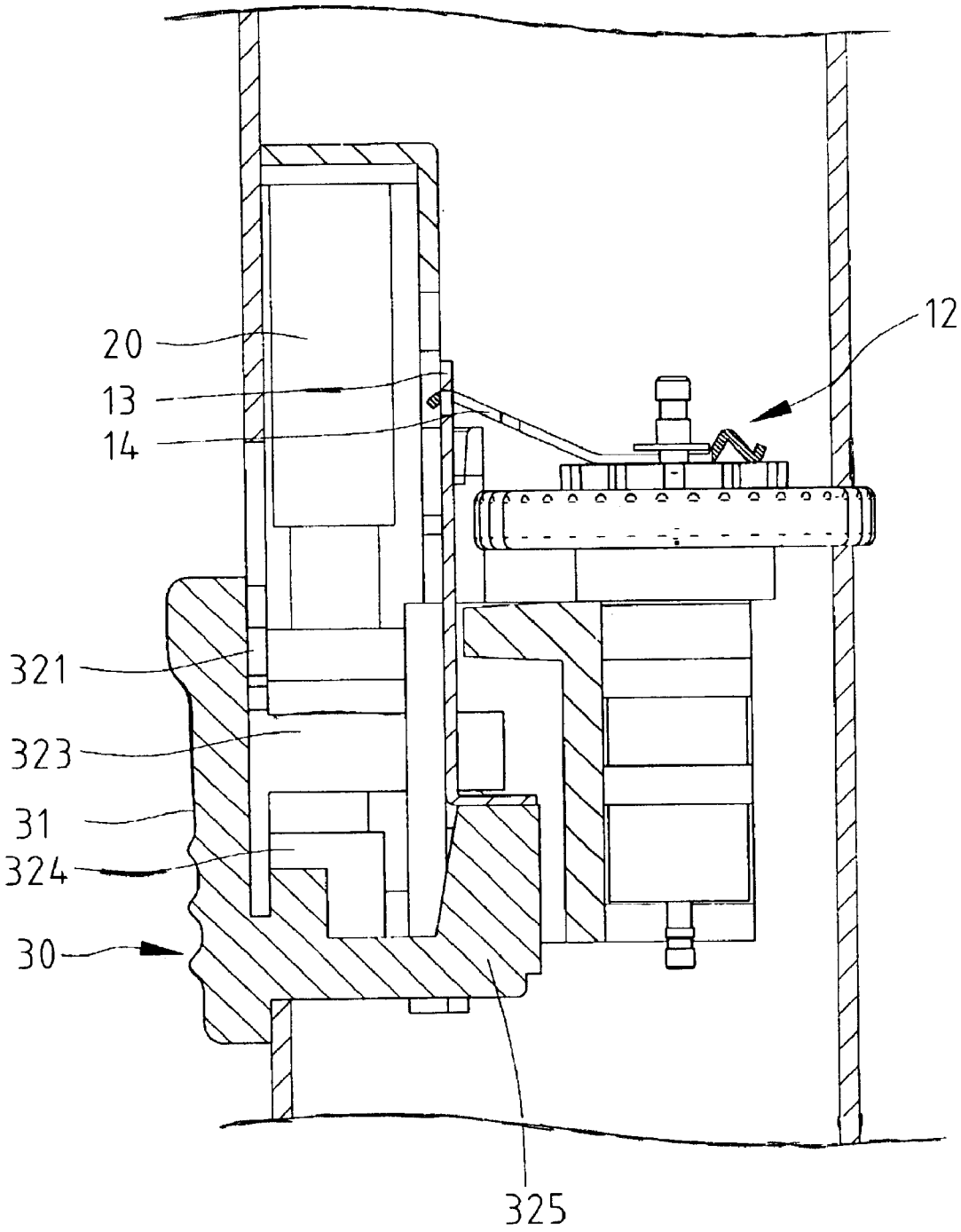
FIG. 6 is a cross-sectional view taken along a line 6—6 in FIG. 5.
Figure 8:
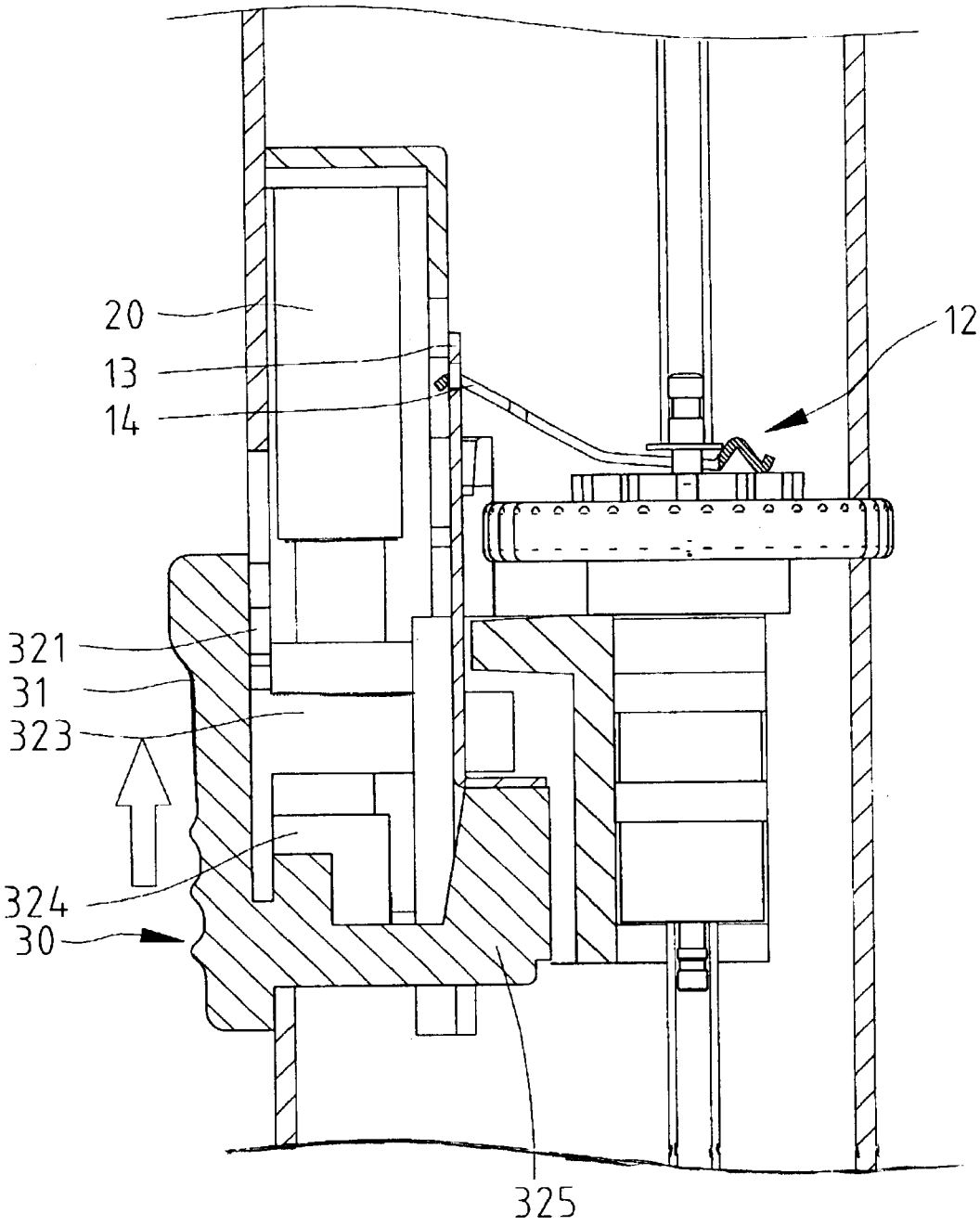
FIG. 8 is a cross-sectional view taken along a line 8—8 in FIG. 7.

Referring to FIGS. 6 and 8, a valve 12 is received in the handle 16. When a file reservoir (not shown) is received in the handle 16, the fuel reservoir is communicated with the valve 12. Dispensing of fuel from the fuel reservoir is under control of the valve 12. The valve 12 includes a lever 14. Operation of the switch actuator 30 causes movement of the lever 14.

Figure 2:
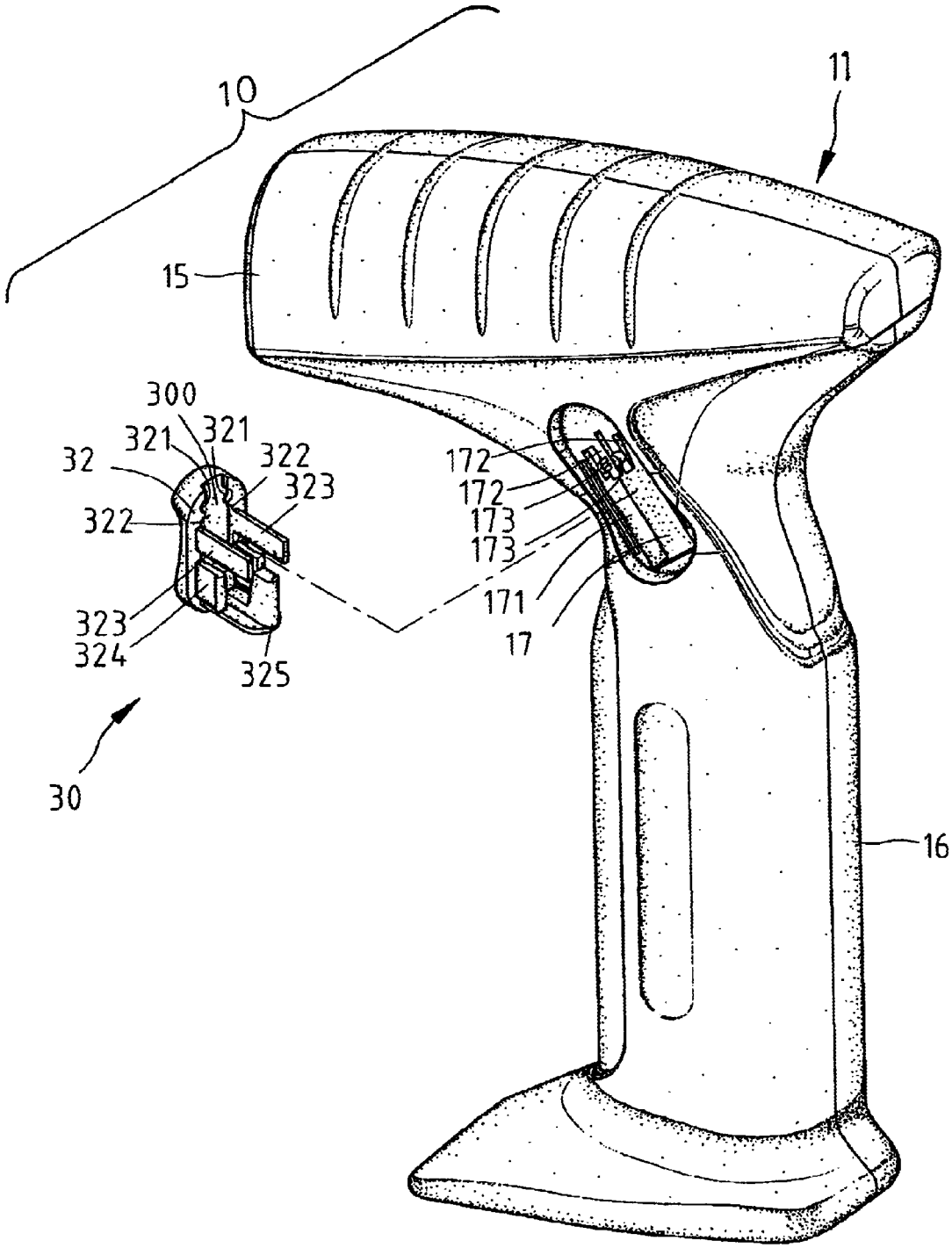
FIG. 2 is an exploded view of the actuating mechanism shown in FIG. 1.

Referring to FIG. 2, one of the halves of the shell 11 of the burner 10 includes a slot 17 with two opposite short edges and two opposite long edges. Each of the long edges of the slot 17 is formed with a wall 171 extending into the handle 16. Two separate strips 172 extend from one of the short edges of the slot 17. A semi-cylindrical boss 173 extends firm each of the strips 172 in a direction opposite to the direction by which the walls 171 extend.

The switch actuator 30 defines a slot 300 with two opposite short edges and two opposite long edges 322. Near one of the short edges of the slot 300, each of the long edges 322 of the slot 300 defines a recess 321 corresponding to one of the semi-cylindrical bosses 173. The switch actuator 30 includes a first side 31 shown in FIG. 1 and a second side 32 shown in FIG. 2. Two tabs 323 extend from the second side 32 of the switch actuator 30 so that the slot 300 is located between them. Two hooks 324 extend from the second side 32 of the switch actuator 30 so that the slot 300 is located between them. Near the remaining one of the short edges of the slot 300, a driving element 325 extends from the second side 32 of the switch actuator 30. Referring to FIG. 1, the first side 31 of the switch actuator 30 is formed with several ribs 311 for engagement with a user's finger.

Figure 3:
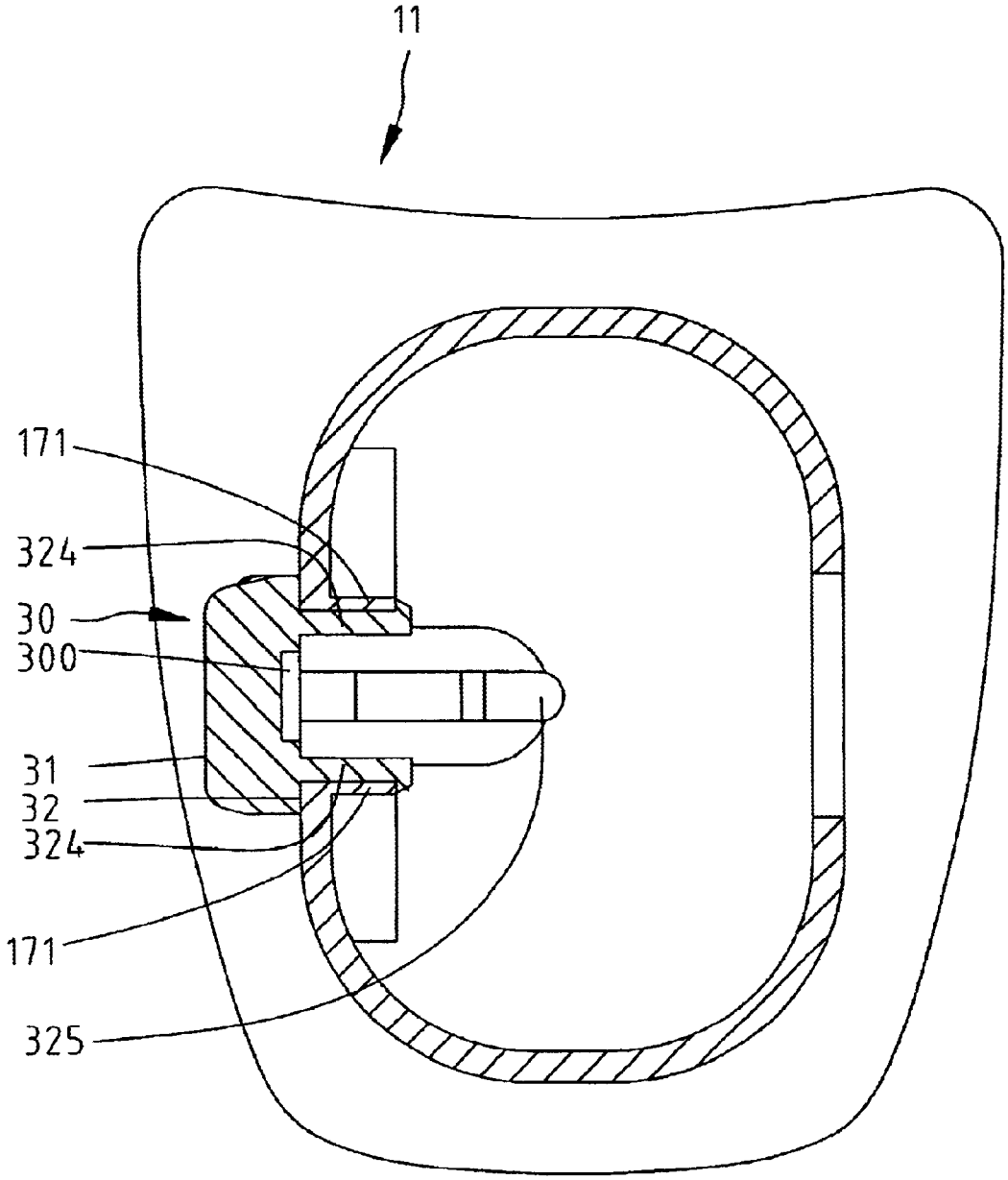
FIG. 3 is a cross-sectional view taken along a line 3—3 in FIG. 1.
Figure 4:
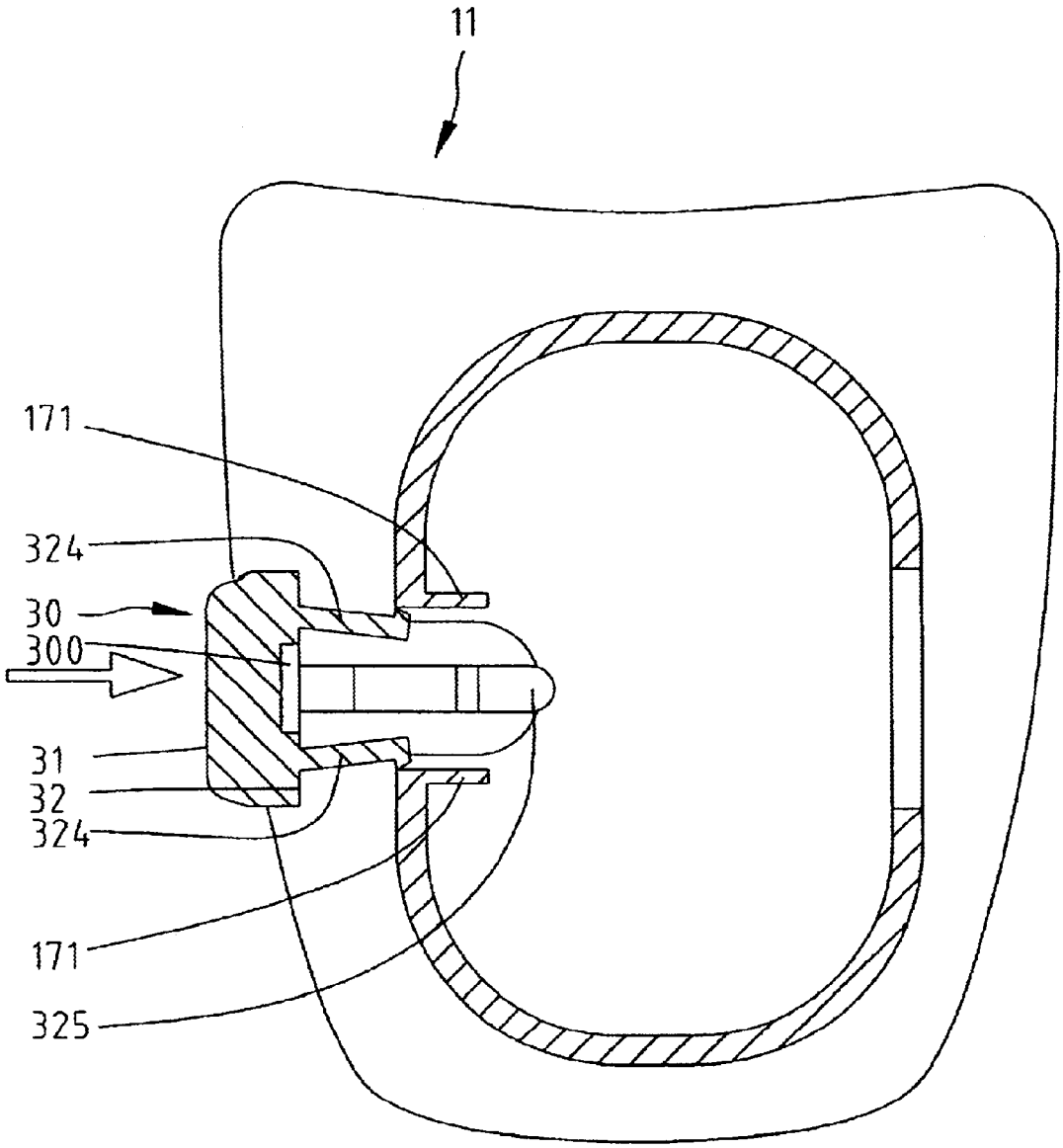
FIG. 4 is similar to FIG. 3 but showing the actuating mechanism in a position during a process of mounting it onto the tool.

Referring to FIG. 4, during a process of mounting the switch actuator 30 onto the shell 11, the hooks 324 are forced into the slot 17. Being made of an elastic material, the hooks 324 can be pivoted toward each other by means of the walls 171 so that the hooks 324 can be moved on and against the walls 171. Referring to FIG. 3, when the process is finished, the hooks 324 are engaged with the walls 171 in order to retain the switch actuator 30 on the shell 11. Although not clearly shown, the tabs 323 can be moved on the walls 171 to facilitate smooth sliding of the switch actuator 30 on the shell 11.

Referring to FIGS. 5–8, an igniter 20 is received in the shell 11 of the burner 10 so that the igniter 20 is located above the switch actuator 30. The igniter 20 includes a first portion fixed in position and a second portion movable relative to the first portion in order to provide a voltage for ignition. The second portion of the igniter 20 is in contact with the switch actuator 30. A plate 13 includes a first end connected with the driving element 325 and a second end connected with the lever 14. The igniter 20 is conventional and hence further details thereof will not be given.

Figure 5:
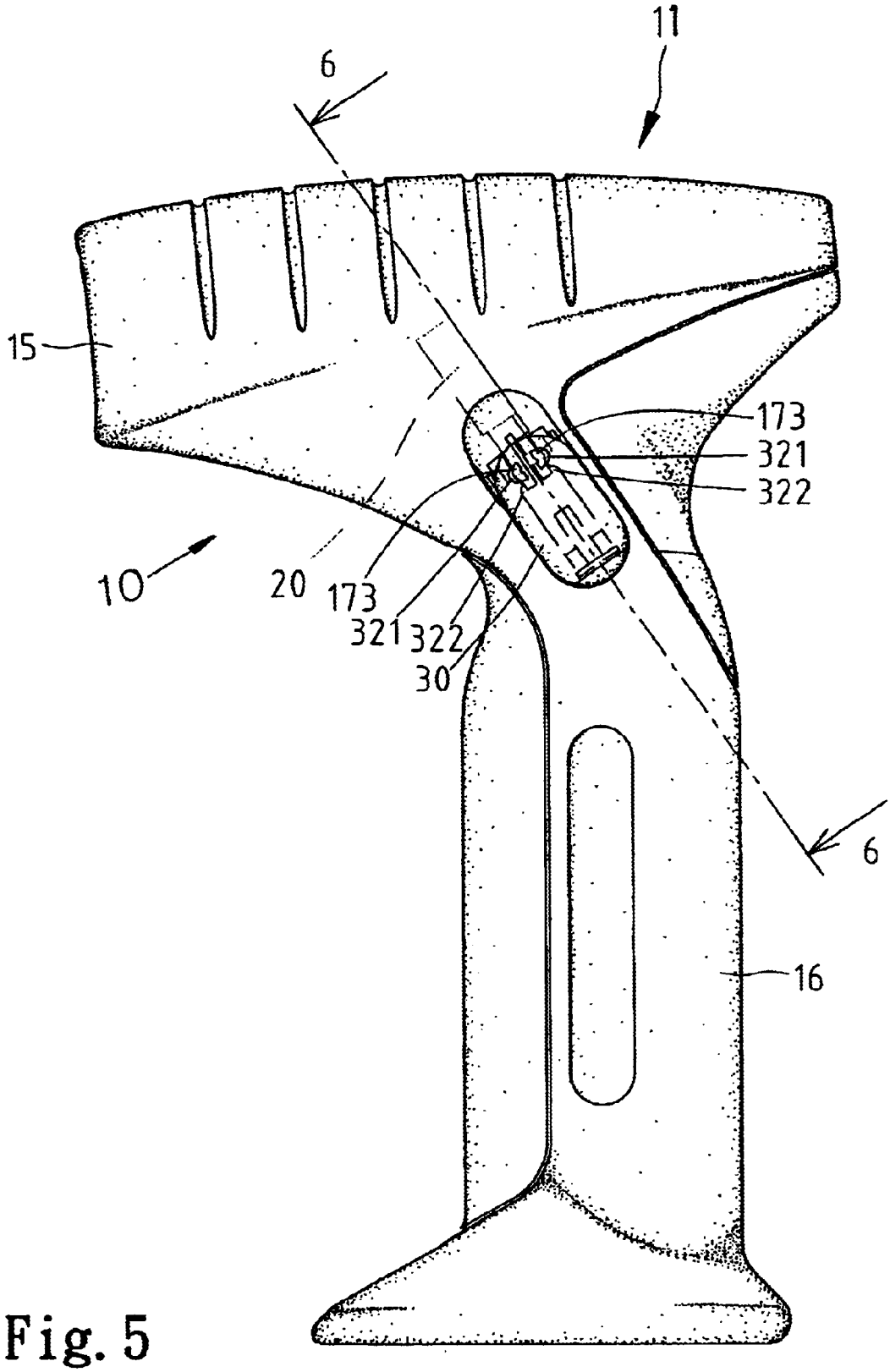
FIG. 5 is a side view of the actuating mechanism in a position on the tool.

Referring to FIG. 5, the semi-cylindrical bosses 173 are retained in the recesses 321 in a releasable manner Referring to FIG. 6, at this instant, the lever 14 is in a first position corresponding to a closed position of the valve 12.

Figure 7:
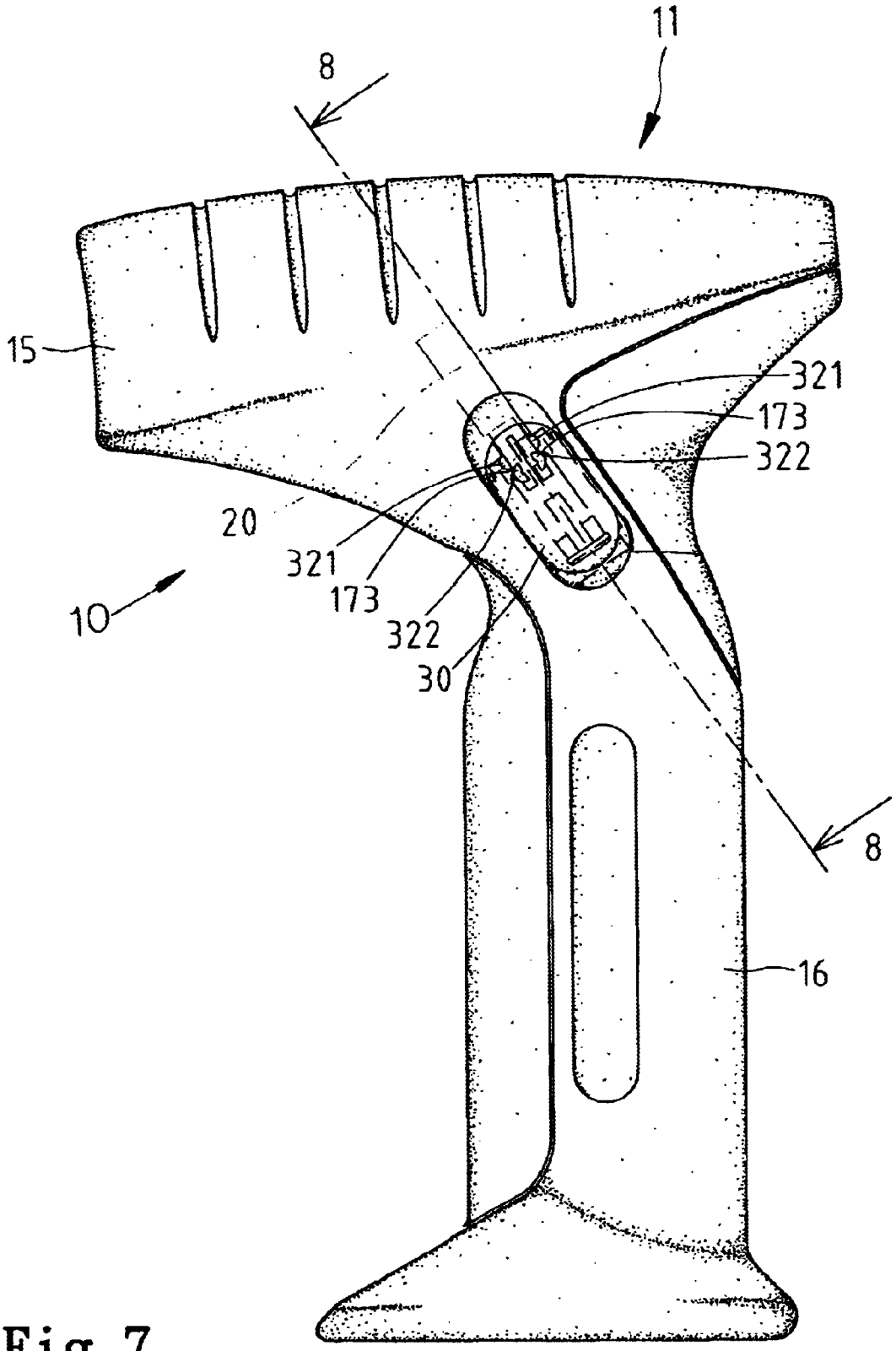
FIG. 7 is a side view of the actuating mechanism in another position on the tool.

Referring to FIGS. 7 and 8, the switch actuator 30 can be moved upward on the shell 11 of the burner 10. Referring to FIG. 7, the semi-cylindrical bosses 173 arm removed from the recesses 321. Referring to FIG. 8, at this insult, though the plate 13, the driving element 325 lifts the lever 14 upward to a second position corresponding to an open position of the valve 12. In the open position, the valve 12 allows venting of the fuel loom the fuel reservoir. At this instant, the second portion of the igniter 20 is moved upward relative to the first portion of the igniter 20 so as to ignite the fuel flowing from the valve 12.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. An actuator mechanism for a tool including:

a shell having an interior and an exterior, with the shell including a slot defined therein, with the slot defining and located between two edges each having a length, with the slot communicating the interior and the exterior of the shell, with the slot having at least one boss formed thereon and intermediate the two edges; and a switch actuator having a first side and a second side, with the first side of the switch actuator being engageable with a user's finger, with the switch actuator including two spaced and parallel hooks, with the two hooks extending from the second side and pivotal toward each other to be inserted through the slot of the shell, with the two hooks each breaking in opposite directions for engagement with the two edges of the slot to hold the switch actuator in the shell, with the switch actuator when held in the shell by the two hooks being slideable by the two hooks along the length of the two edges to facilitate actuation of another element of the tool, with the second side of the switch actuator having at least one recess defined therein for receiving the at least one boss in a releasable manner.

2. The actuating mechanism for a tool according to claim 1 wherein the switch actuator includes two tabs extending from the second side thereof for insertion in the slot, with the two tabs being spaced and parallel, wherein when the switch actuator is held in the shell by the two hooks, the two tabs arm adjacent and slideable on the two edges of the slot respectively and along the length of the two edges.

3. The actuating mechanism for a tool according to claim 1 wherein the switch actuator includes a driving element extending from the second side thereof through the slot of the shell when the switch actuator is held to the shell by the two hooks, with the driving element adapted for driving another element of the tool.

4. The actuating mechanism for a tool according to claim 1 wherein the switch actuator includes a slot defined therein between two edges, and wherein at least one of the two edges of the slot of the switch actuator defines the at least one recess for receiving the at least one boss.

5. The actuating mechanism for a tool according to claim 4 wherein the at least one boss is a semi-cylinder, and the at least one recess is semi-circular.

6. The actuating mechanism for a tool according to claim 4 wherein the slot of the shell has two short edges opposite each other and generally perpendicular to the two edges of the slot of the shell, with two separate strips extending from one of the two short edges, with the two separate strips being parallel and spaced from the two edges of the slot, wherein the shell includes two bosses, with the two bosses being defined on the two separate strips, and each of the edges by the slot of the switch actuator defines a recess for receiving one of the bosses.

7. The actuating mechanism for a tool according to claim 1 wherein the tool is a burner.

8. The actuating mechanism for a burner according to claim 7 wherein the switch actuator includes a driving element extending from a side thereof through the slot and adapted for driving a valve of the tool to effect a fuel flow of the burner.

9. The actuating mechanism for a tool according to claim 7, wherein the switch actuator is adapted to be in contact with an igniter of the burner to facilitate ignition of a fuel of the burner simultaneous with effecting the fuel flow of the burner when the switch actuator is moved from a first position to a second position, with the first position adapted to correspond to a closed position of the valve and the second position adapted to cause an open position of the valve of the burner.

10. The actuating mechanism for a tool according to claim 1 wherein the two edges of the slot of the shell each include a wall on the interior of the shell, with the wall extending from the edge toward the interior of the shell and generally perpendicular to the slot and parallel to the two tabs of the switch actuator when the two tabs are inserted into the slot of the shell, with the two walls extending along the length of the two edges, with the two hooks of the switch actuator engaging the walls of the two edges of the slot to hold the switch actuator in the shell, with the switch actuator being slideable on the walls along the length of the two edges.

11. The actuating mechanism for a tool according to claim 1 wherein the first side of the switch actuator defines several ribs adapted for engagement with the user's finger.

* * * * *